US007194859B1

(12) United States Patent
Sawdon et al.

(10) Patent No.: US 7,194,859 B1
(45) Date of Patent: Mar. 27, 2007

(54) INTENSIFIER

(75) Inventors: Edwin G. Sawdon, St. Clair, MI (US); Steven J. Sprotberry, Marysville, MI (US); Brian D. Petit, Algonac, MI (US)

(73) Assignee: BTM Corporation, Marysville, MI (US)

( * ) Notice: Subject to any disclaimer, the term of this patent is extended or adjusted under 35 U.S.C. 154(b) by 0 days.

(21) Appl. No.: 11/252,988

(22) Filed: Oct. 18, 2005

(51) Int. Cl.
*F15B 11/032* (2006.01)
*F15B 3/00* (2006.01)

(52) U.S. Cl. ..... 60/565; 60/581

(58) Field of Classification Search ..... 60/560, 60/565, 567, 581
See application file for complete search history.

(56) References Cited

U.S. PATENT DOCUMENTS

| | | | | |
|---|---|---|---|---|
| 2,740,258 | A | 4/1956 | Weber | |
| 2,827,766 | A | 3/1958 | Hufford | |
| 2,867,088 | A | 1/1959 | Kux | |
| 3,426,530 | A | 2/1969 | Georgelin | |
| 3,633,365 | A | 1/1972 | Belknap | |
| 4,135,076 | A | 1/1979 | Beneteau | |
| 4,271,671 | A | 6/1981 | Smeets | |
| 4,300,351 | A | 11/1981 | Grullmeier | |
| 4,395,027 | A | 7/1983 | Nordmeyer | |
| 4,499,728 | A | 2/1985 | Therond | |
| 4,993,226 | A | 2/1991 | De Kok | |
| 5,107,681 | A | 4/1992 | Wolfbauer, III | |
| 5,218,821 | A | 6/1993 | Beneteau | |
| 5,247,871 | A | 9/1993 | Brasca et al. | |
| 5,265,423 | A | 11/1993 | Glaser | |
| 5,429,036 | A | 7/1995 | Latos | |
| 5,526,644 | A * | 6/1996 | Brieschke | 60/565 |
| 5,582,009 | A | 12/1996 | Brieschke | |
| 5,649,424 | A | 7/1997 | Valavaara | |
| 5,865,029 | A | 2/1999 | Brieschke | |
| 5,943,862 | A | 8/1999 | Malina | |
| 6,735,944 | B2 | 5/2004 | Sawdon | |
| 6,779,343 | B2 | 8/2004 | Sawdon | |

OTHER PUBLICATIONS

Tox Pressotechnik product brochure, 12 pages, publication date unknown, but believed to be prior to Oct. 18, 2005.
Multicyl product brochure, 8 pages, dated Oct. 1998.

(Continued)

*Primary Examiner*—Thomas E. Lazo
(74) *Attorney, Agent, or Firm*—Harness, Dickey & Pierce, P.L.C.

(57) ABSTRACT

An intensifier is operable to supply force and includes a housing defining a cavity. A ram is slidably positioned within the cavity and partially extends from the housing. The intensifier also includes a force transfer rod and a plurality of power pistons. The ram is moveable between retracted and extended positions along a longitudinal axis. The force transfer rod is selectively moveable between a retracted position where the force transfer rod is not axially aligned with the ram and an advanced position where the force transfer rod is axially aligned with the ram. The plurality of power pistons are axially aligned with each other and the ram. The power pistons are selectively operable to provide an output force to the ram when the force transfer rod is in the advanced position.

31 Claims, 7 Drawing Sheets

OTHER PUBLICATIONS

Aries Engineering Company Inc. product brochure, 5 pages, publication date unknown, but believed to be prior to Oct. 18, 2005.
Farger & Joosten product brochure, 4 pages, dated Sep. 1999.
Farger & Joosten product brochure, 2 pages, dated Mar. 1999.
Alfamatic product information from website, 2 pages, publication date unknown, but believed to be prior to Oct. 18, 2005.
G.P.A. Italiana S.p.A. product information from website, 2 pages, publication date unknown, but believed to be prior to Oct. 18, 2005.
Attexor Inc. product brochure, 2 pages, publication date unknown, but believed to be prior to Oct. 18, 2005.
OHMA Piercing Cylinder Product Guide, Version 3.0, 36 pages, dated 2003.

* cited by examiner

INTENSIFIER

BACKGROUND AND SUMMARY OF THE INVENTION

The present invention relates generally to a force producing apparatus and, more particularly, to an air-to-air pressure intensifier for providing relatively large forces to machines such as clamps, grippers, presses and punches.

Many systems utilize the basic principle of inserting a rod into an enclosed oil-filled chamber to produce a relatively high force over a short working stroke. These devices utilize air pressure and/or springs to force the liquid into a working chamber before the pressure is intensified by insertion of the rod. Air at a relatively low pressure provides the force to insert the rod into the liquid chamber to intensify force output from the device.

While air-to-oil intensifiers have provided desirable functions in the workplace, simplified devices may be desirable. For example, many air-to-oil intensifiers exhibit oil leaks and require an oil level indicator to alert an operator when oil must be added. Air sometimes becomes trapped within the liquid chambers causing a reduced force output. An operator is required to bleed the air from the chamber. Furthermore, these devices typically require high pressure seals and hydraulic fluid that have a predetermined service life which is recommended for replacement after a certain number of cycles.

Some air-to-oil intensifiers utilize an external oil tank that must be mounted in a vertical orientation. Mounting this type of unit on a robot may pose a challenge due to the robot changing positions during operation. Additional hoses and piping must be incorporated to mount such an oil reservoir.

Other devices known as air toggle presses are also used to produce high forces. These devices typically have a limited working stroke and weight. Furthermore, toggle presses typically only produce high forces near the bottom of the ram stroke.

Accordingly, it may be beneficial to provide an air-to-air pressure intensifier operable to produce relatively high forces over a short working stroke without the need for a liquid filled chamber. It may also be beneficial to provide a device eliminating the need for an external oil reservoir.

An intensifier constructed in accordance with the present invention is operable to supply force and includes a housing defining a cavity. A ram is slidably positioned within the cavity and partially extends from the housing. The intensifier also includes a force transfer rod and a plurality of power pistons. The ram is moveable between retracted and extended positions along a longitudinal axis. The force transfer rod is selectively moveable between a retracted position where the force transfer rod is not axially aligned with the ram and an advanced position where the force transfer rod is axially aligned with the ram. The plurality of power pistons are axially aligned with each other and the ram. The power pistons are selectively operable to provide an output force to the ram when the force transfer rod is in the advanced position.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
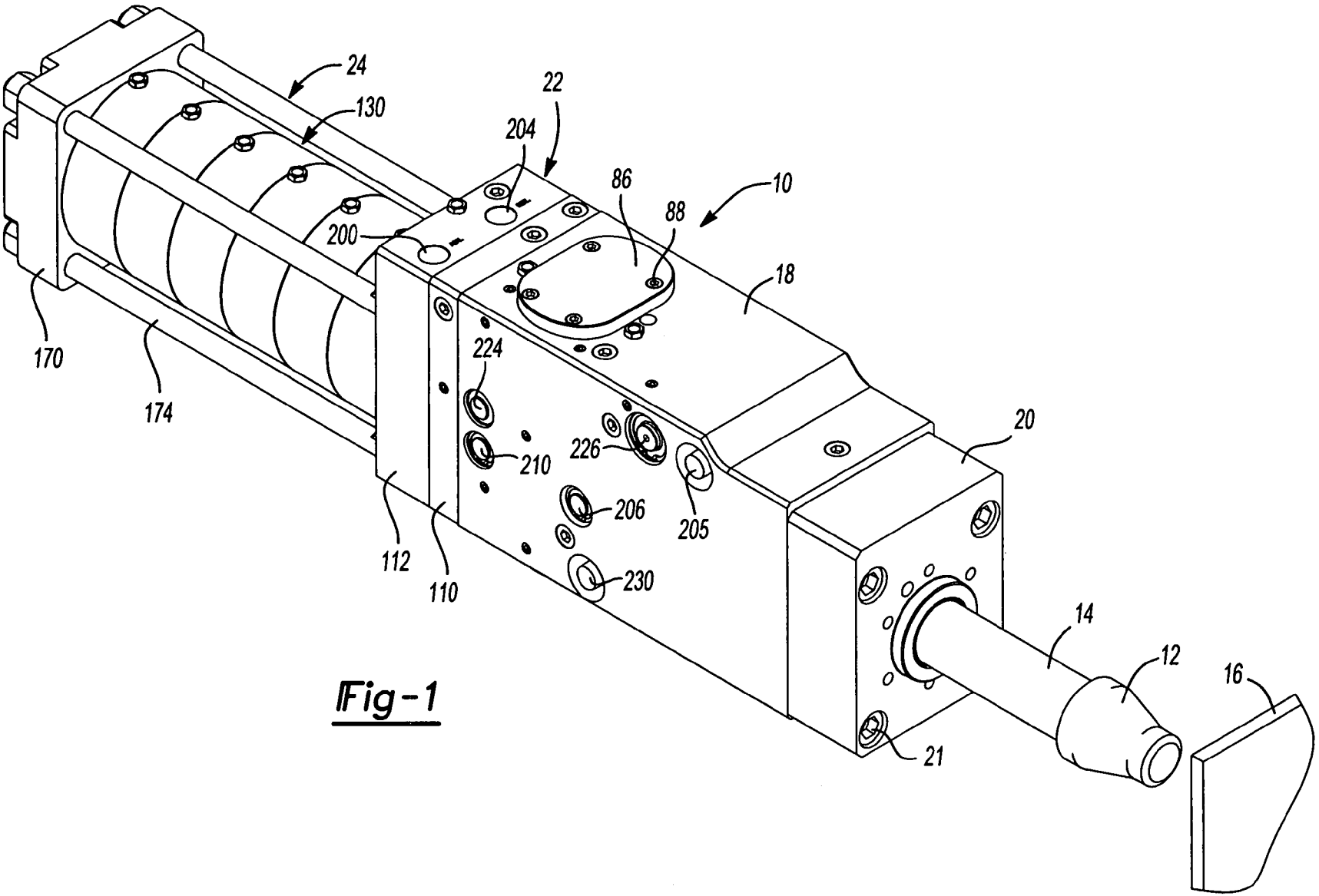
FIG. 1 is a perspective view of an air-to-air intensifier.

The following description of the preferred embodiments is merely exemplary in nature and is in no way intended to limit the invention, its application, or uses.

With reference to FIGS. 1–8, an air-to-air pressure intensifier constructed in accordance with the teachings of the present invention is identified at reference numeral 10. Pressure intensifier 10 functions to provide a relatively large output force at a driven end using only compressed air at relatively low pressure (80–100 psi) as the power source. Pressure intensifier 10 utilizes only air throughout the mechanism and does not include a cavity storing liquid. Typically, the driven end of the pressure intensifier is coupled to tooling such as a clamp half, a rivet hammer or a punch, collectively identified as a tool 12.

Pressure intensifier 10 operates by advancing and retracting a ram 14 to place tool 12 into engagement with a workpiece 16. As will be described in greater detail hereinafter, pressure intensifier 10 operates to rapidly translate tool 12 toward workpiece 16 using relatively low force. Once ram 14 extends a predetermined distance and places tool 12 adjacent to or in contact with workpiece 16, pressure intensifier 10 generates a greatly multiplied force between tool 12 and workpiece 16. On the return stroke, a piston with a relatively large working area is pressurized to retract ram 14 for the next work cycle.

Pressure intensifier 10 includes a substantially rectangular cylinder housing 18 in slidable receipt of ram 14. A front end cap 20 is coupled to one end of cylinder housing 18 via threaded fasteners 21. A power cylinder assembly 22 is coupled to an opposite end of cylinder housing 18. A power pack 24 is mounted to power cylinder assembly 22.

Front end cap 20 includes a through bore 26 in sliding receipt of ram 14. Ram 14 includes a substantially cylindrically shaped rod portion 28 extending through front end cap 20 and an enlarged head portion 30 slidably positioned within a first cavity 32 formed within cylinder housing 18. A pair of seals 34 are positioned in grooves formed within front end cap 20 to sealingly engage rod portion 28 and resist ingress of contamination within cylinder housing 18. Another pair of seals 36 are positioned within grooves formed on head portion 30 to sealingly engage the walls of first cavity 32.

An anti-rotate rod 38 has a first end mounted within a pocket 40 of cylinder housing 18 and a second end positioned within a pocket 42 formed in front end cap 20. Anti-rotate rod 38 extends through head portion 30 and is supported by an anti-rotate bearing 44 coupled to ram 14. Anti-rotate bearing 44 and ram 14 are free to axially slide relative to anti-rotate rod 38. Accordingly, ram 14 is operable to axially translate within first cavity 32 but is restricted from rotation relative to cylinder housing 18 and front end cap 20.

A connecting rod 50 is threadably coupled to ram 14. Connecting rod 50 includes a substantially cylindrically shaped elongated portion 52 and an enlarged head portion 54. Enlarged head portion 54 includes a drive recess 56 sized and shaped to accept a drive tool. The drive tool is rotated when threadingly coupling the rod 50 to ram 14. Portion 52 of connecting rod 50 extends through an aperture 58 formed within an interior wall 60 of cylinder housing 18. A seal 62 is positioned within aperture 58 to sealingly engage cylindrical portion 52 of connecting rod 50. Enlarged head portion 54 of connecting rod 50 is positioned within a second cavity 64 formed within cylinder housing 18.

A middle piston 72 is slidable within a transversely extending bore 74 formed within cylinder housing 18. Middle piston 72 is substantially cylindrically shaped and operable to translate along a transverse axis 76. Middle piston 72 includes a first counterbore 78 and a second counterbore 80 extending along axis 76. First counterbore 78 is in communication with a first transverse bore 82 extending through middle piston 72. A second transverse bore 84 is spaced apart from first transverse bore 82 and extends into middle piston 72 as well. Bore 74 is capped on each end by a plate 86. Plates 86 are coupled to cylinder housing 18 by fasteners 88. A seal 89 is positioned between each plate 86 and cylinder housing 18.

A force transfer rod 90 is slidably positioned within first transverse bore 82 of middle piston 72. More specifically, force transfer rod 90 includes a substantially cylindrical section 91 slidably positioned within first transverse bore 82 and an enlarged head portion 92 located at one end of force transfer rod 90. An opposite end 93 of force transfer rod 90 engages a cam block 94 positioned within second cavity 64. Cam block 94 is mounted to cylinder housing 18 via a threaded fastener 95. Cam block 94 includes an angled cam face 96 to translate force transfer rod 90 to a desired position during the retract stroke.

A pressure pad assembly 98 is positioned within first counterbore 78 and is operable to apply a frictional load to force transfer rod 90 to maintain the relative position between middle piston 72 and force transfer rod 90 during certain modes of operation. Pressure pad assembly 98 includes a cap 100, a spring 102 and a friction element 104. Friction element 104 is placed in biased engagement with force transfer rod 90 to slightly restrict the relative movement between the force transfer rod and middle piston 72. A shuttle spring 106 is positioned within second counterbore 80 and is sized to bias middle piston 72 and force transfer rod 90 toward a retracted position shown in FIGS. 4 and 5. As will be described in greater detail hereinafter, middle piston 72 and force transfer rod 90 are moveable between the retracted position and an advanced position shown in FIG. 6.

Power cylinder assembly 22 includes a seal plate 110 and a front cylinder 112 coupled to one another to define a first power piston cavity 114. A first power piston 116 is slidably positioned within first power piston cavity 114. A front rod 118 is mounted to power piston 116. Seal plate 110 includes an aperture 120 in sliding receipt of front rod 118. Front rod 118 is substantially cylindrically shaped having an outer cylindrical surface 122 in engagement with a seal 124 positioned within aperture 120. Front rod 118 includes a front end face 126 and a rear end face 128.

Power pack 24 includes six power piston subassemblies 130. It should be appreciated that the number of power piston subassemblies 130 may vary based on the desired force output. Each power piston subassembly 130 includes a cylinder housing 132, a power piston 134 and a power piston rod 136. Each cylinder housing 132 is substantially cylindrically shaped and includes an end wall 138 and a hollow cylindrical side wall 140. End wall 138 includes a stepped annular surface 142 sized to receive the side wall 140 from an adjacent power piston subassembly 130. A cavity 144 is formed when adjacent cylinder housings 132 are coupled to one another. Each power piston 134 is slidable within cavity 144. In the example shown in the Figures, power pistons 134 are operable to translate approximately 15 mm. A seal 146 engages side wall 140 to retain compressed air within each cavity 144. Each power piston rod 136 includes an axial through bore 150 and transversely extending passageways 152 at one end. Passageways 152 are in fluid communication with bore 150. Each power piston rod 136 includes a front end face 154 and a rear end face 156. Each cylinder housing 132 includes an exhaust passageway 158 allowing a portion of each cavity 144 to communicate with the atmosphere. A muffler 160 is mounted to each cylinder housing 132 to minimize contamination within power pack 24. An end cap 170 houses a power piston 134 within a cavity 172 formed therein. Fasteners 174 extend through apertures 176 formed in end cap 170. Fasteners 174 threadingly engage cylinder housing 118 to couple power pack 24 to power cylinder assembly 22.

Figure 2:
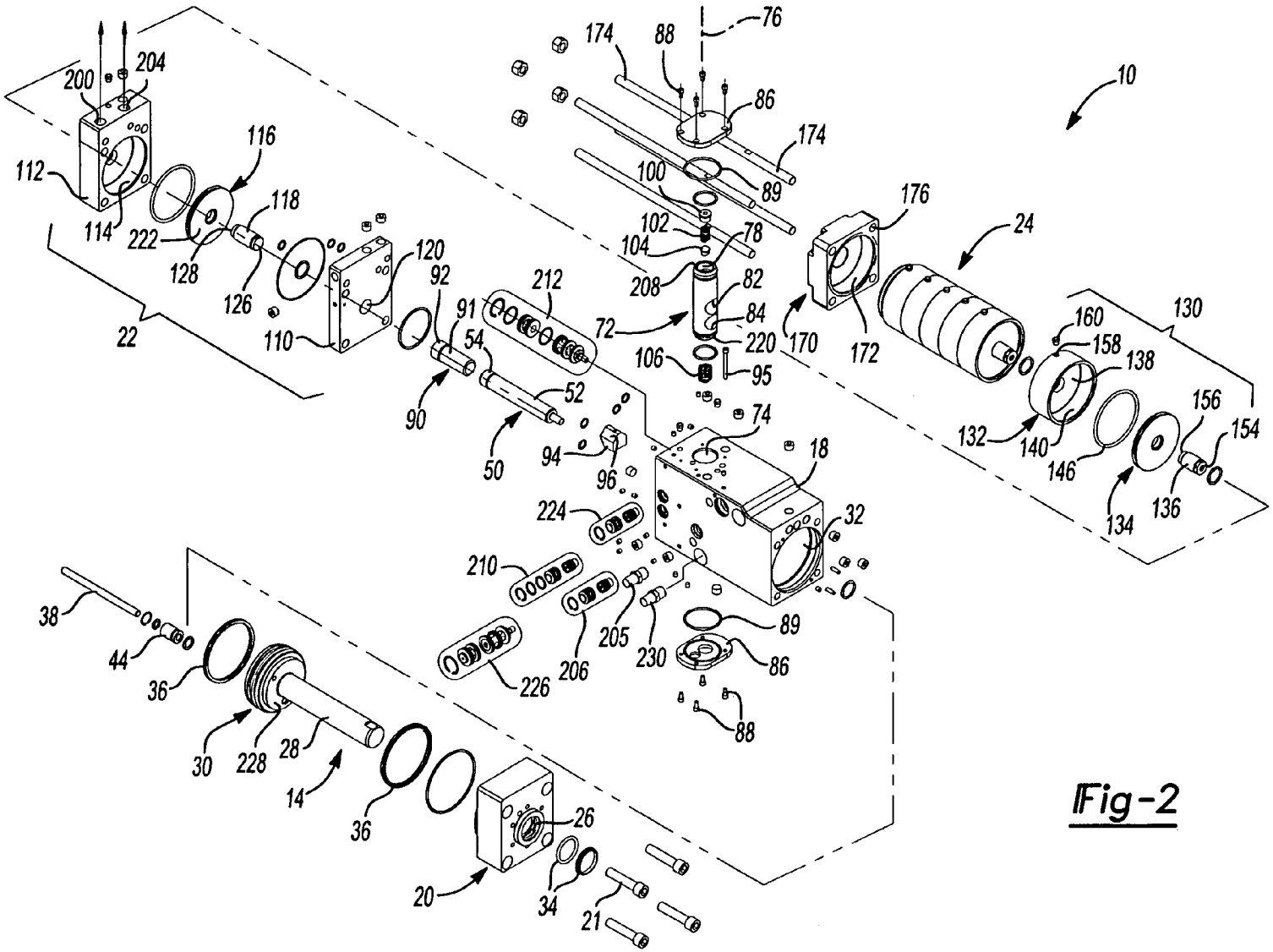
FIG. 2 is an exploded perspective view of the intensifier shown in FIG. 1.
Figure 3:
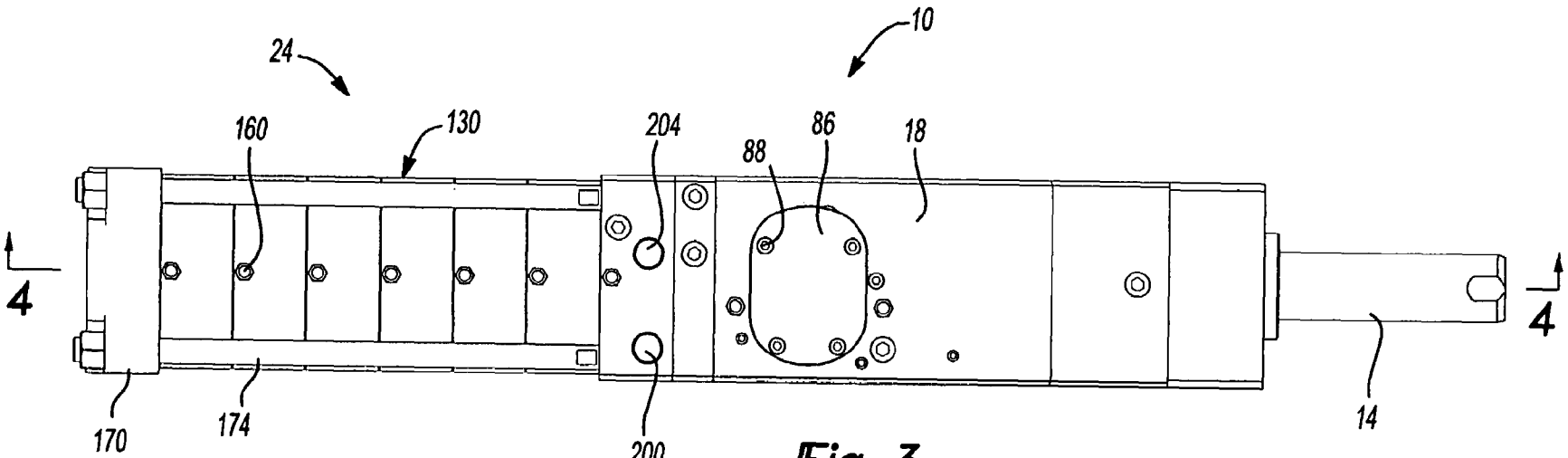
FIG. 3 is a top view of the intensifier shown in FIG. 1.
Figure 4:
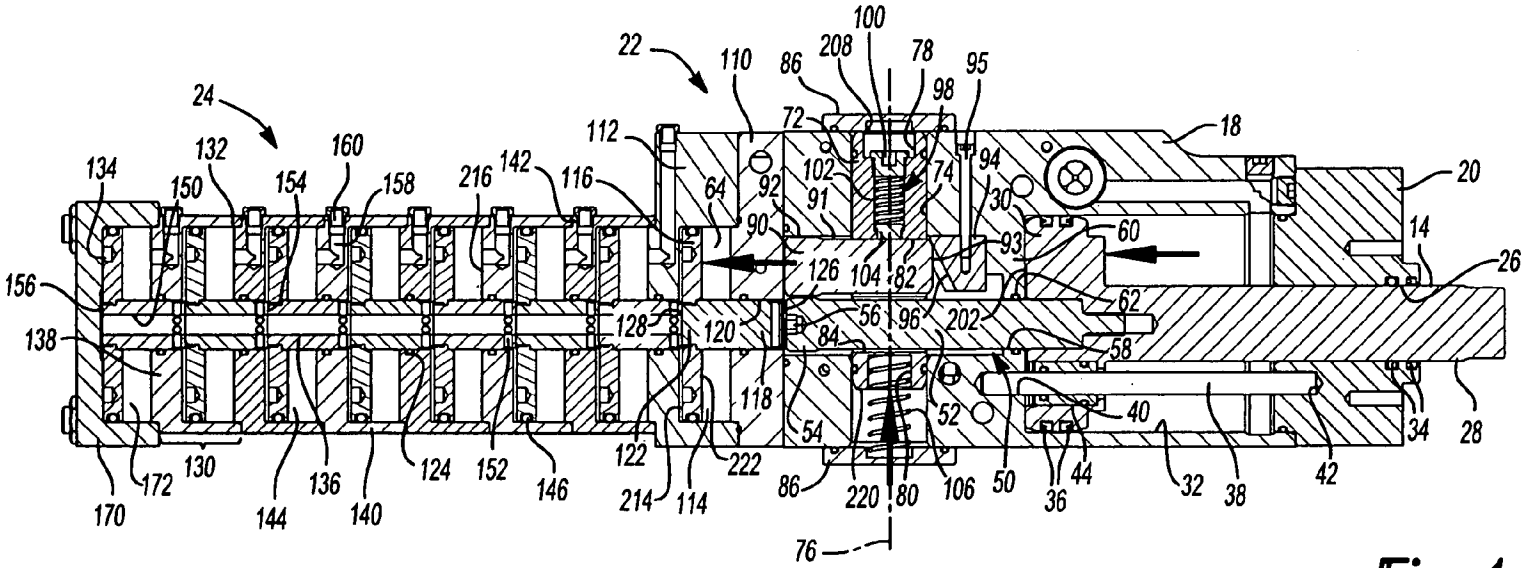
FIG. 4 is a cross-sectional view taken along line 4—4 as shown in FIG. 3 depicting a ram and a force transfer rod in retracted positions.
Figure 5:
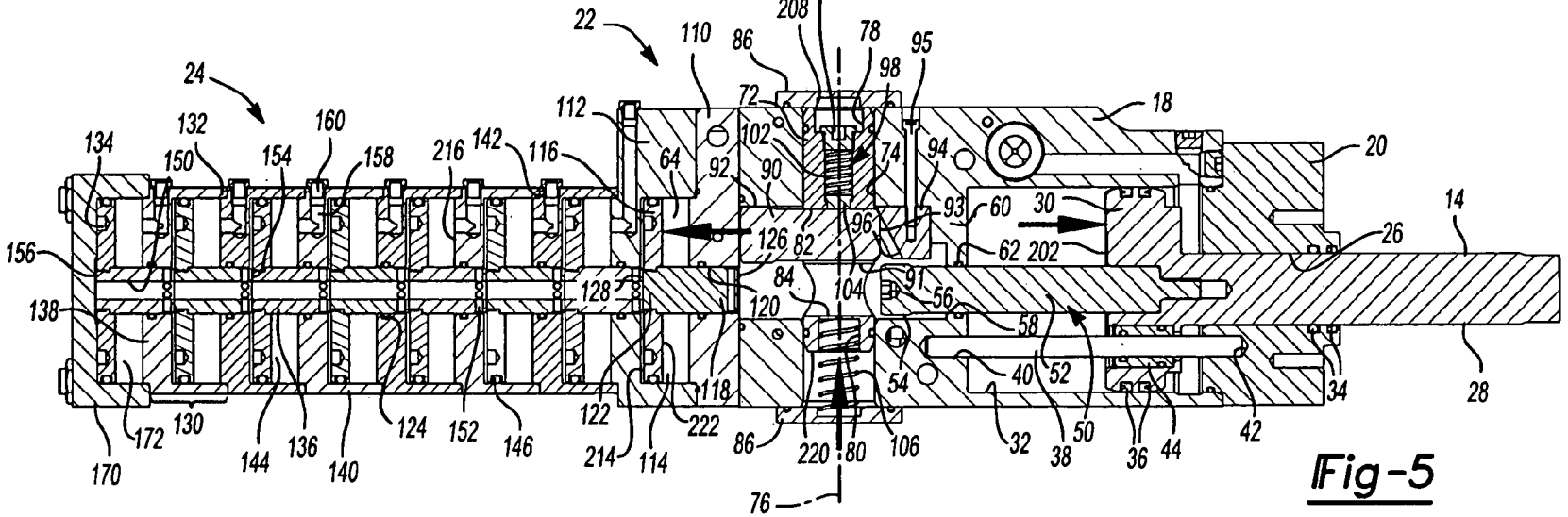
FIG. 5 is a cross-sectional view similar to FIG. 4 except that the ram is shown in a partially extended position.
Figure 6:
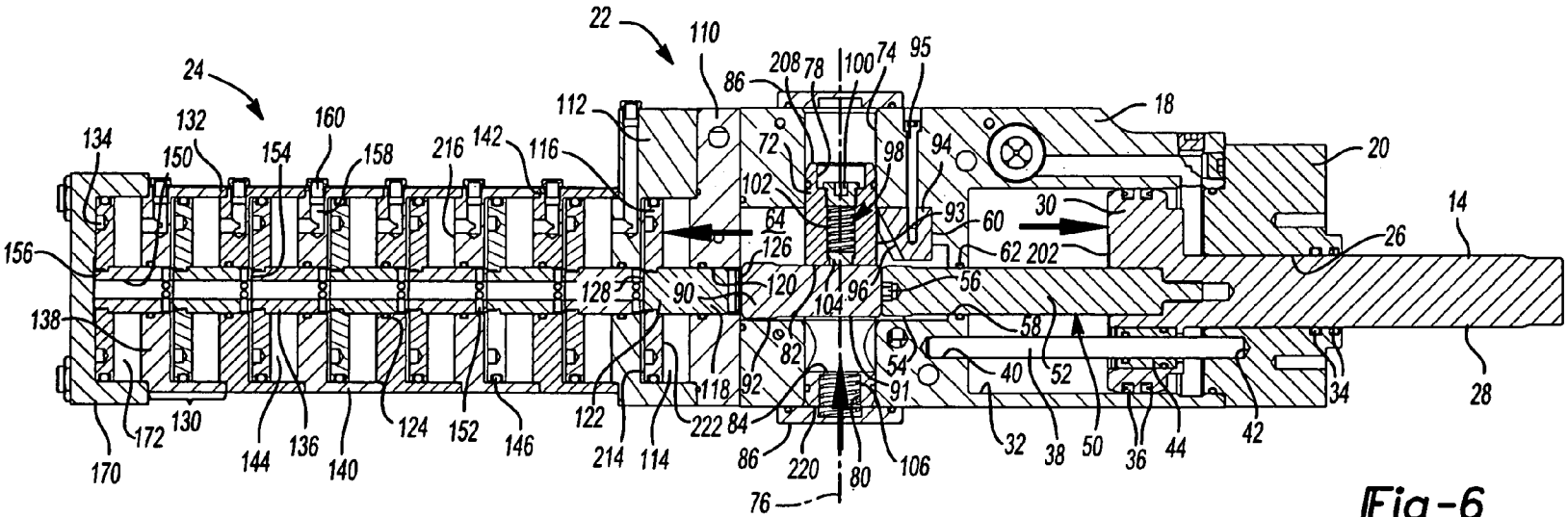
FIG. 6 is a cross-sectional view showing the force transfer rod in an advanced position and power pack pistons being positioned in retracted positions.
Figure 7:
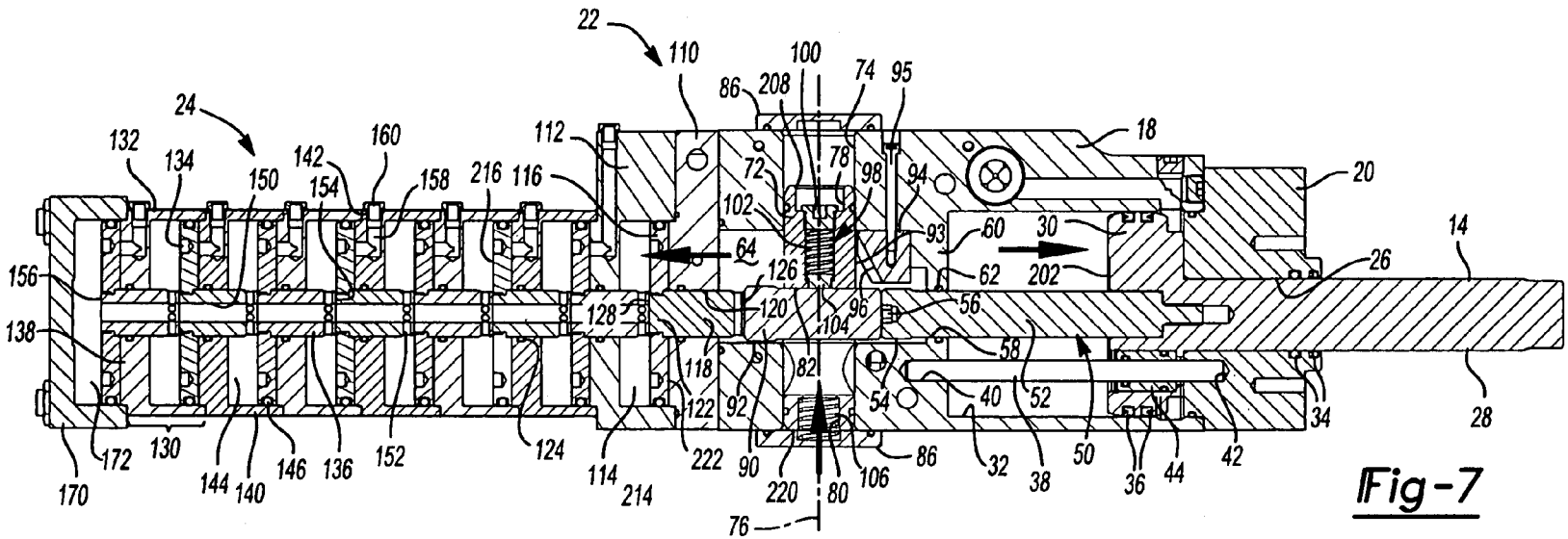
FIG. 7 is a cross-sectional view showing the power pack pistons in advanced positions as well as the ram in a fully extended position.
Figure 8:
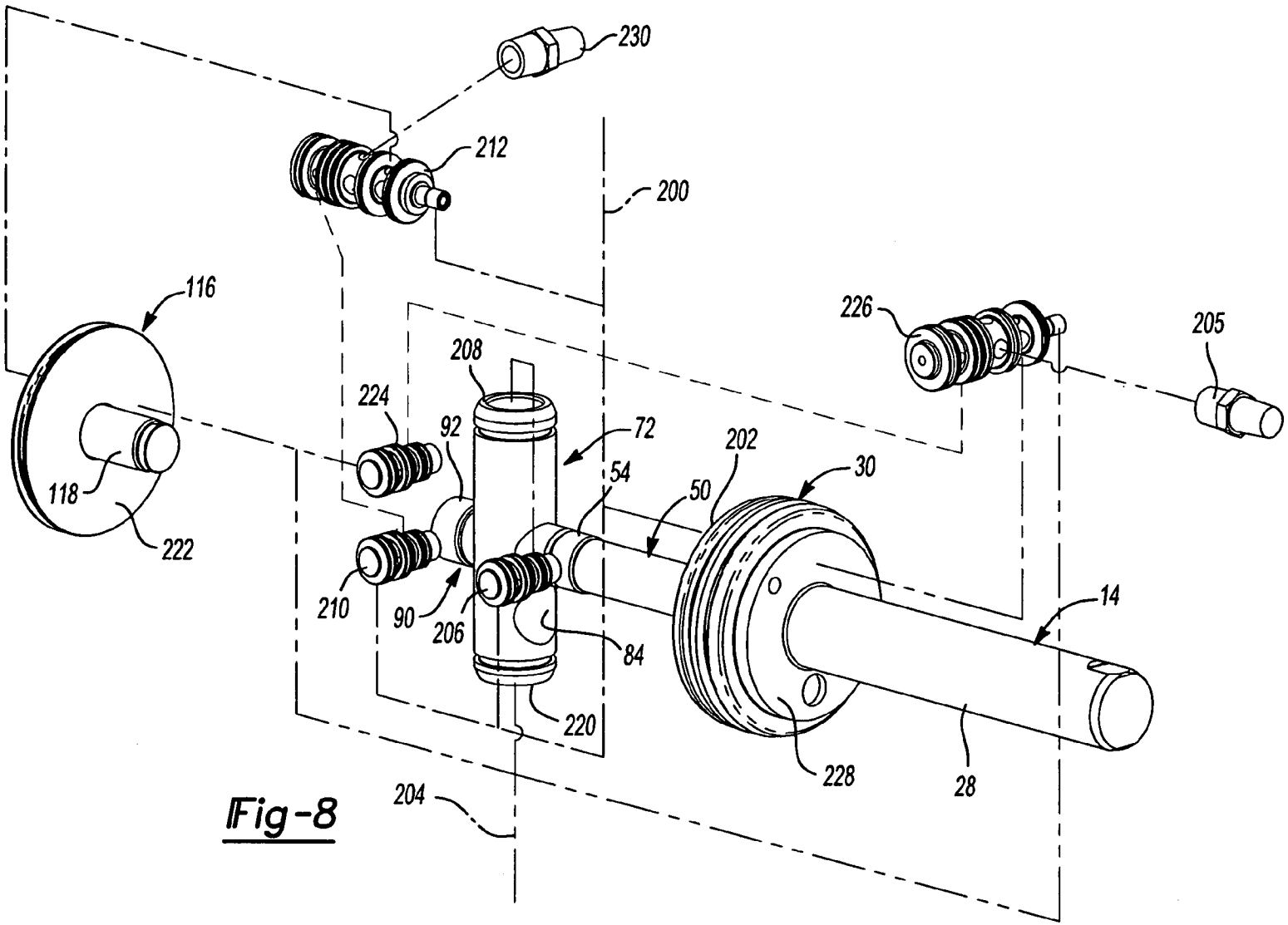
FIG. 8 is an exploded perspective schematic depicting a valving system and air passageways within the intensifier.

As best shown in FIGS. 2 and 8, pressure intensifier 10 includes a number of pneumatic valves operable to selectively supply air to a number of locations within the pressure intensifier corresponding to predetermined modes of operation. An advance port 200 is formed within front cylinder 112. Advance port 200 is in fluid communication with cavity 32 and a rear face 202 of head portion 30 of ram 14. A description of the operation of pressure intensifier 10 begins with each of power pistons 134, middle piston 72, force transfer rod 90 and ram 14 being in their retracted positions as shown in FIG. 4.

To actuate intensifier 10, pressurized air is provided to advance port 200 and a retract port 204 formed within front cylinder 112 is opened to atmosphere via a muffler 205. Air passageways in communication with advance port 200 are shown in centerline representation. Pressurized air acts on rear face 202 and ram 14 translates to the partially advanced position depicted in FIG. 5. This position roughly corresponds to a position where tool 12 initially contacts or is proximate to workpiece 16. Once the connecting rod 50 and ram 14 translate to the position depicted in FIG. 5, enlarged head portion 54 of connecting rod 50 engages a first ball valve 206. First ball valve 206 is mounted within cylinder housing 18. Pressurized air is allowed to pass by first ball valve 206 and act upon a first end 208 of middle piston 72. The pressure acting on first end 208 is sufficient to overcome the force provided by shuttle spring 106 and both piston 72 and force transfer rod 90 are translated to the advanced position shown in FIG. 6.

Once force transfer rod 90 is in the advanced position, head portion 92 of force transfer rod 90 engages a second ball valve 210. Second ball valve 210 is mounted within cylinder housing 18. Pressurized air provided through advance port 200 passes through second ball valve 210 and functions as a pilot signal (shown as a hidden line) to a first cartridge valve 212. First cartridge valve 212 is also mounted within housing 18. The pilot signal provided from second ball valve 210 shuttles first cartridge valve 212 to a position allowing the pressurized air supplied from advance port 200 to act on a rear face 214 of power piston 116. Once pressurized air is in communication with rear face 214, air flows through transversely extending passageways 152 as well as through each axial bore 150 of each power piston rod 136. In this manner, a rear face 216 of each power piston 134 is acted upon by pressurized air provided through advance port 200.

One skilled in the art will appreciate that a greatly amplified force is provided to ram 14 due to the summed surface area of each power piston 134, power piston 116 and head portion 30 of ram 14 being acted upon by pressurized air. Once each of the power pistons have been provided with pressurized air as described, power pistons 134, power piston rod 136, power piston 116, front rod 118, force transfer rod 90, connecting rod 50 and ram 14 move to the fully advanced positions shown in FIG. 7. It is contemplated that the work to be completed on workpiece 16 occurs during the time when ram 14 travels from the partially advanced position shown in FIG. 6 to the fully advanced position depicted in FIG. 7. The distance traveled during this portion of the advance stroke corresponds to the approximate 15 mm of travel each power piston 134 may travel. It should be noted that the structure of pressure intensifier 10 having moveable force transfer rod 90 allows the ram stroke to be variable and the length of the force transfer rod to be determined based on the chosen ram stroke. Accordingly, the ram stroke may be substantially greater than the power piston stroke. Exemplary pressure intensifier 10 has a ram stroke of 100 mm but strokes of 50 mm and 150 mm are contemplated. Therefore, the ram stroke may be at least three times the length of the power piston stroke.

After the depressing, punching or gripping work has been completed, pressurized air is no longer supplied to advance port 200 but instead is provided to retract port 204. Air passageways in communication with retract port 204 are shown in phantom line representation. Retract port 204 is plumbed in fluid communication with a second end 220 of middle piston 72. Pressurized air is also provided to a front face 222 of power piston 116. The pressure acting on second end of middle piston 72 causes the middle piston to begin to move from the advanced position toward the retracted position. During this movement, end 93 of force transfer rod 90 engages cam face 96 of cam block 94. Force transfer rod 90 is axially moved toward the retracted position as middle piston 72 moves toward its retracted position based on the angle and position of cam face 96.

Once middle piston 72 has moved to the retracted position, head portion 92 of force transfer rod 90 engages a third ball valve 224. Third ball valve 224 is displaced such that pressurized air entering retract port 204 is allowed to pass through third ball valve 224 and provide a pilot signal (shown as a hidden line) to a second cartridge valve 226. Upon receipt of the pilot signal, second cartridge valve 226 is displaced to a position allowing pressurized air entering retract port 204 to act on a front face 228 of ram 14. Because force transfer rod 90 is now in the retracted position, clearance exists between connecting rod 50 and front rod 118. Air previously acting on rear face 202 of ram 14 is allowed to escape to atmosphere via a passageway through first cartridge valve 212 and a muffler 230. Accordingly, ram 14 is axially translated to the retracted position. At this time, each of power piston 116, power pistons 134, middle piston 72, force transfer rod 90, and ram 14 are in their retracted positions ready to begin the next work cycle.

Figure 9:
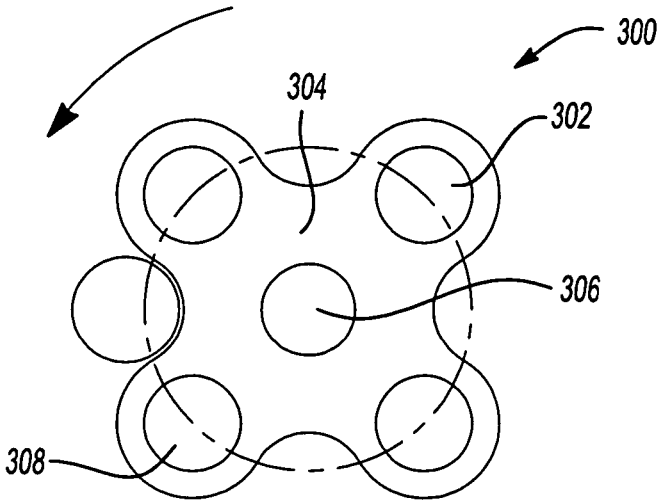
FIG. 9 is an end view of an alternate embodiment revolver having multiple force transfer rods.

FIG. 9 depicts a revolver 300 loaded with force transfer rods 302. Revolver 300 is an alternate embodiment mechanism contemplated to replace the middle piston 72 and force transfer rod 90 previously described. Revolver 300 includes a cartridge 304 rotatable about a pin 306. Cartridge 304 supports each force transfer rod 302 substantially similarly to the support provided by middle piston 72 to force transfer rod 90. Cartridge 304 includes a plurality of recesses 308 sized and shaped to allow connecting rod 50 to pass by cartridge 304 and between adjacent force transfer rods 302. Revolver 300 operates by rotating cartridge 304 and force transfer rods 302 in 45° increments. Accordingly, one of force transfer rods 302 may be placed in an advanced position by aligning the force transfer rod 302 with connecting rod 50 and ram 14. A 45° rotation of cartridge 304 places force transfer rods 302 in their retracted positions and allows connecting rod 50 to be placed in its retracted position as well.

Figure 10:
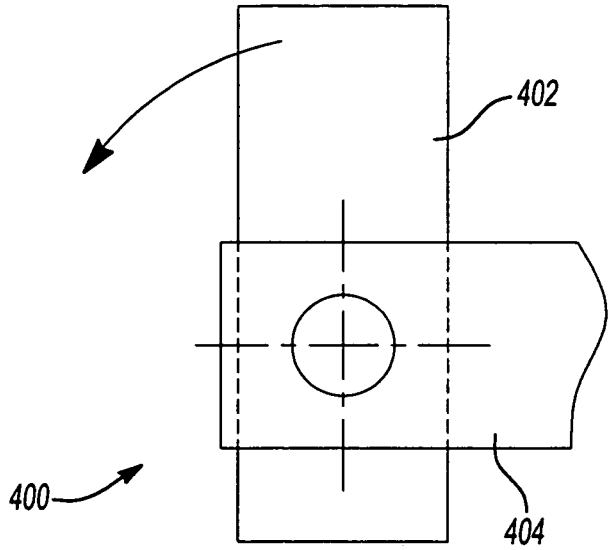
FIG. 10 is a side view of an alternate embodiment rotary arrangement depicting a force transfer rod in an advanced position.
Figure 11:
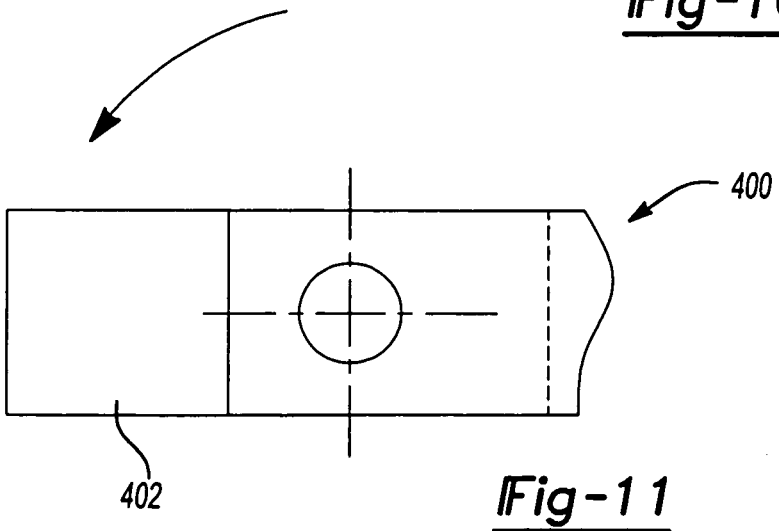
FIG. 11 is a side view showing the rotary unit of FIG. 10 having the force transfer rod in a retracted position.

FIG. 10 depicts a rotary mount 400 as an alternate embodiment to the middle piston 72 and force transfer rod 90 arrangement previously described. Rotary mount 400 includes a force transfer rod 402 rotatably mounted to a frame 404. Force transfer rod 402 is shown in an advanced position where force transfer rod 402 is coaxially aligned with connecting rod 50 and ram 14. FIG. 11 depicts force transfer rod 402 in a retracted position. Frame 404 and force transfer rod 402 are positioned to allow connecting rod 50 to pass thereby and allow ram 14 to be placed in a retracted position.

Furthermore, the foregoing discussion discloses and describes merely exemplary embodiments of the present invention. One skilled in the art will readily recognize from such discussion, and from the accompanying drawings and claims, that various changes, modifications and variations may be made therein without department from the spirit and scope of the invention as defined in the following claims.

What is claimed is:

1. An intensifier for supplying force, the intensifier comprising:

a housing defining a cavity;

a ram slidably positioned within the cavity and partially extending from the housing, the ram being moveable between retracted and extended positions along a longitudinal axis;

a force transfer rod being selectively moveable between a retracted position where the force transfer rod is not axially aligned with the ram and an advanced position where the force transfer rod is axially aligned with the ram; and a plurality of power pistons axially aligned with each other and the ram, the plurality of power pistons being selectively operable to provide an output force to the ram when the force transfer rod is in the advanced position.

2. The intensifier of claim 1 further including a middle piston positioned within the housing and being moveable along a transverse axis, the force transfer rod being coupled to the middle piston for movement between the retracted and advanced positions.

3. The intensifier of claim 2 wherein the force transfer rod is axially moveable relative to the middle piston.

4. The intensifier of claim 3 wherein the force transfer rod is operatively engageable with a cam to axially move the force transfer rod.

5. The intensifier of claim 4 further including a brake providing resistance to axial movement of the force transfer rod relative to the middle piston.

6. The intensifier of claim 2 wherein the middle piston is biased toward the retracted position.

7. The intensifier of claim 2 wherein the middle piston includes an aperture in receipt of a portion of the ram when the ram and the force transfer rod are in their retracted positions.

8. The intensifier of claim 1 wherein the force transfer rod is positioned adjacent to the ram when both of the force transfer rod and the ram are in their retracted positions.

9. The intensifier of claim 1 further including a hollow piston rod coupled to one of the power pistons, the hollow piston rod providing a passageway for compressed air to act on another one of the power pistons.

10. The intensifier of claim 1 further including an end cap and an anti-rotate rod, the end cap being coupled to the housing, the ram extending through the end cap, the anti-rotate rod extending through the ram and having a first end mounted to the end cap and a second end mounted to the housing to restrict rotation of the ram relative to the housing.

11. The intensifier of claim 1 further including a first valve selectively operable to transfer pressurized air to the middle piston based on the position of the ram.

12. The intensifier of claim 11 further including a second valve selectively operable to transfer pressurized air to the power pistons based on the position of the force transfer rod.

13. The intensifier of claim 12 further including a third valve selectively operable to transfer pressurized air to the second valve to change the position of the second valve and selectively open or close an air passageway.

14. An intensifier for supplying force, the intensifier comprising:

a housing;

a ram slidably positioned within the housing and partially extending therefrom, the ram being moveable between retracted and extended positions;

a force transfer rod being selectively moveable between a retracted position where the force transfer rod is not axially aligned with the ram and an advanced position where the force transfer rod is axially aligned with the ram; and a number of power piston subassemblies axially aligned with each other and the ram, each power piston subassembly being selectively operable to provide an output force to the ram when the force transfer rod is in the advanced position, wherein the number of power piston subassemblies used is determined by the magnitude of output force required.

15. The intensifier of claim 14 wherein each power piston subassembly includes a cylinder housing, a power piston and a piston rod, the piston rod being coupled to the power piston, the power piston and the piston rod being moveable within the housing between advanced and retracted positions.

16. The intensifier of claim 15 wherein each cylinder housing is adapted to be coupled to another cylinder housing.

17. The intensifier of claim 16 wherein each cylinder housing includes an exhaust passageway to atmosphere.

18. The intensifier of claim 17 wherein each piston rod includes a passageway to provide pressurized air to an adjacent power piston.

19. The intensifier of claim 18 further including a power piston subassembly cap having apertures in receipt of fasteners, the fasteners coupling the power piston subassemblies to the housing.

20. The intensifier of claim 15 wherein each power piston may travel a predetermined power piston stroke and wherein the ram may travel a predetermine ram stroke, the ram stroke being at least three times greater than the power piston stroke.

21. An intensifier for supplying force to a workpiece, the intensifier comprising:

a housing;

a ram at least partially slidably positioned within the housing, the ram being moveable between a retracted position and an extended position and being adapted to supply force to the workpiece;

a plurality of pistons selectively operable to provide force to the ram; and a first valve positioned within the housing and operable to supply pressurized air to the plurality of pistons after the ram has moved from the retracted position to an intermediate position closer to the extended position than the retracted position.

22. The intensifier of claim 21 further including a force transfer rod selectively positionable between the plurality of pistons and the ram in driving engagement with the ram when the ram is in the intermediate position.

23. The intensifier of claim 22 wherein the force transfer rod is blocked from being positioned between the plurality of pistons and the ram when the ram is in the retracted position.

24. The intensifier of claim 23 further including a second valve positioned within the housing and operable to provide a pilot signal to the first valve when the force transfer rod is positioned between the plurality of pistons and the ram.

25. The intensifier of claim 24 wherein the second valve is engaged by a portion of the force transfer rod when it is positioned between the plurality of pistons and the ram.

26. A method of operating an intensifier having a longitudinally translatable ram, a transversely moveable force transfer rod, a plurality of power pistons and a plurality of valves, the method comprising:

applying pressurized air to the ram;

moving the ram from a retracted position to a partially advanced position;

moving the force transfer rod from a retracted position to an advanced position where the force transfer rod is substantially coaxially aligned with the ram;

applying pressurized air to the plurality of power pistons to provide a force acting on the force transfer rod and the ram to output an amplified force and move the ram to a fully advanced position.

27. The method of claim 26 further including slidably positioning the force transfer rod in an aperture formed in a middle piston.

28. The method of claim 27 further including applying pressurized air to the middle piston to transversely move the force transfer rod.

29. The method of claim 26 further including coaxially aligning each of the power pistons with the ram.

30. The method of claim 26 further including selectively actuating at least one of the plurality of valves by contacting the one valve with a portion of the force transfer rod.

31. The method of claim 30 wherein pressurized air is applied to the plurality of power pistons after the one valve is actuated.

* * * * *